United States Patent [19]

Klamer et al.

[11] Patent Number: 4,608,027

[45] Date of Patent: Aug. 26, 1986

[54] SOFT PROPELLABLE TOY

[76] Inventors: Reuben B. Klamer, 969 Hilgard Ave., Los Angeles, Calif. 90024; Donald Greenwood, 3117 Lakeshore Dr., Longmowt, Colo. 80501

[21] Appl. No.: 501,536

[22] Filed: Jun. 6, 1983

[51] Int. Cl.[4] ..... A63H 29/00

[52] U.S. Cl. ..... 446/457; 446/486

[58] Field of Search ..... 46/206, 208, 209, 201, 46/202, 87, 88, 119; 446/457, 459, 465, 470, 486, 431, 269, 279, 289, 290, 291, 292, 461

[56] References Cited

U.S. PATENT DOCUMENTS

| | | | |
|---|---|---|---|
| 2,012,343 | 8/1935 | Goriup | 46/206 |
| 2,363,785 | 11/1944 | Gold | 446/486 |
| 2,455,430 | 12/1948 | Luckhaupt | 46/119 |
| 2,840,951 | 7/1958 | Green | 46/88 X |

*Primary Examiner*—Mickey Yu
*Attorney, Agent, or Firm*—Lyon & Lyon

[57] ABSTRACT

An easily propellable toy constructed substantially of a soft, compressible, resilient material such as polyurethane foam or other foam rubber-like material, wherein the resiliency of the material is captured and converted to rotational motion which moves the toy. A compression plate on the top portion of the toy is depressed by the child playing with the toy, causing compression of the foam rubber body of the toy. When the compression plate is released, the natural resiliency of the foam material pushes the compression plate up, simultaneously causing linear movement of an elongate member which is attached to the underside of the compression plate. This linear movement of the elongate member is converted, by means of a gear train, to rotational movement which is then communicated to the wheels of the toy.

13 Claims, 4 Drawing Figures

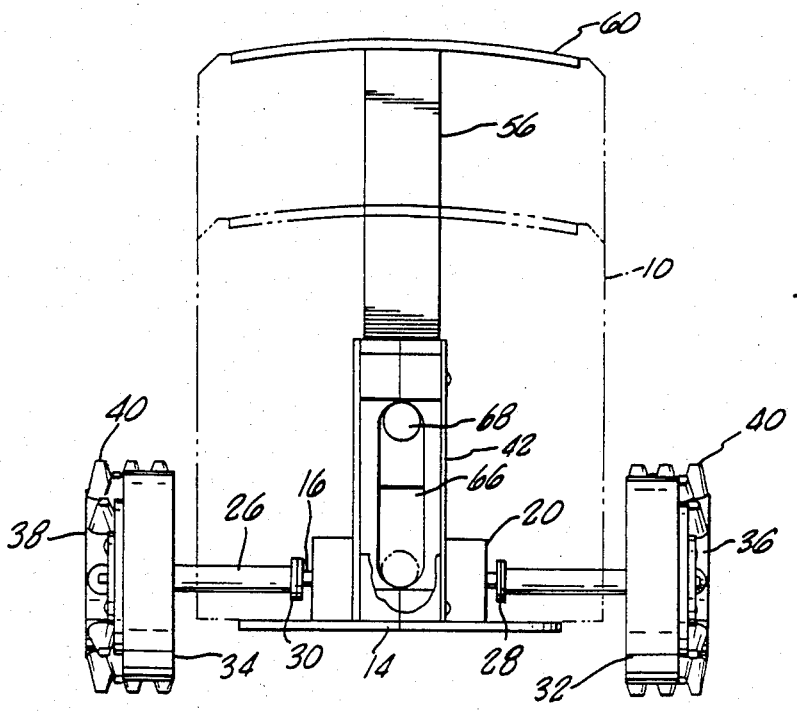
FIG. 3.
FIG. 4.
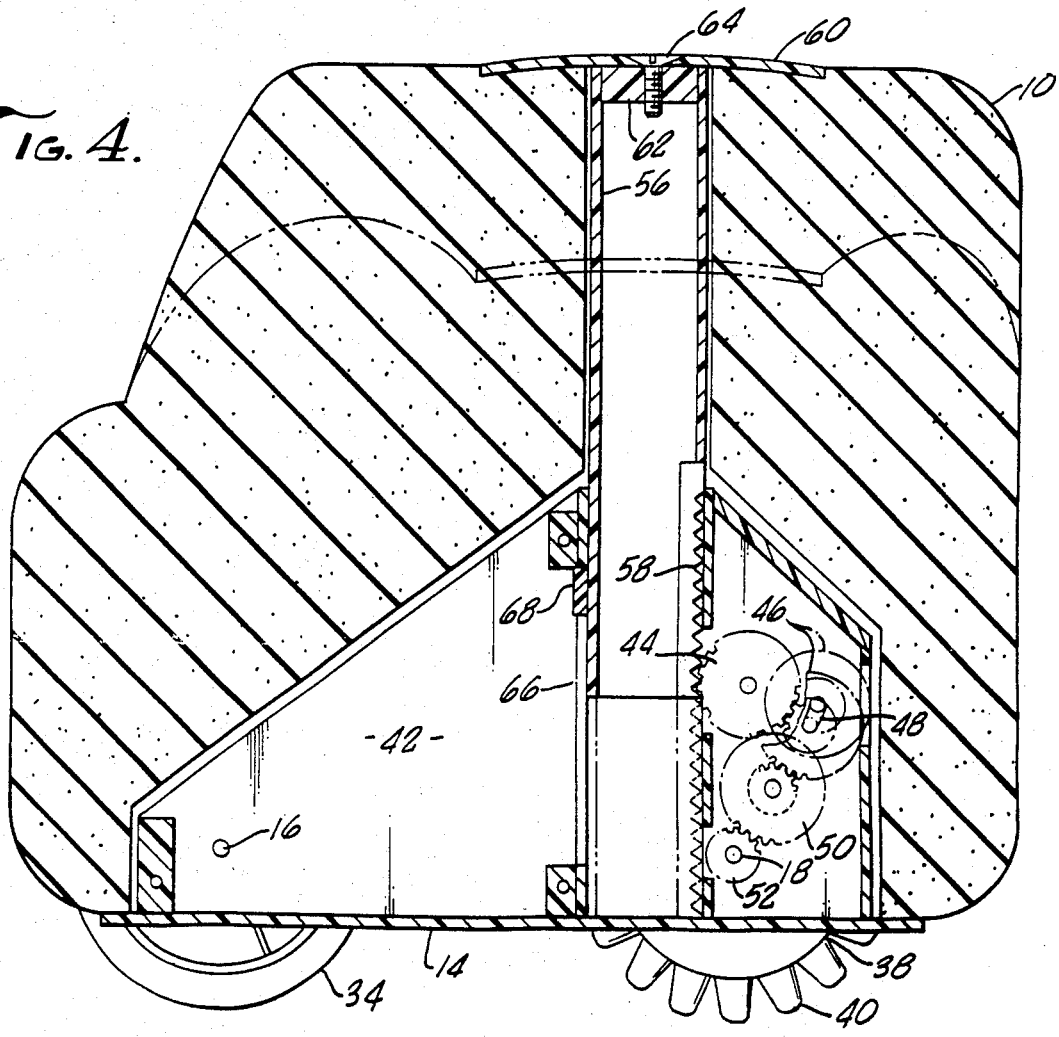

SOFT PROPELLABLE TOY

BACKGROUND OF THE INVENTION

1. Field of Invention

This invention pertains to propellable toys; that is, toys which will move after some input of energy by the child playing with the toy. More specifically, this invention pertains to a toy intended for use primarily by children of preschool age, although the inventive concepts claimed herein may be used in toys for older children.

2. Description of the Prior Art

Toys for the play and enjoyment of small children are as old in the art as man. Surely, one of the first things early mother wanted was something to amuse her small child. Countless varieties of what have come to be referred to as "Preschool Toys" have been designed and developed. Preschool toys are typically intended for children of age 6 and less and are generally considered to be a separate classification of toys. These preschool toys can be broadly classified into three categories: firstly, toys that are designed for operation by an adult for the amusement of the child; secondly, toys that are designed for operation by the child himself; and thirdly, toys that are designed for adult/child cooperative operation.

Because the child at this age has undeveloped coordination and manual dexterity, such preschool toys of the second category must be designed for simple operation. Additionally, toys of this type must be designed to be as safe as possible, not only for the child playing with the toy, but for other children who may be in the vicinity, and for furniture and other objects which may be in the play area. For these reasons, preschool toys are often constructed of soft material such as the toy shown in Manning, U.S. Pat. No. 3,835,583.

Still, any preschool toy must be sufficiently "fun" to first attract, and then retain the attention of a preschool youngster, whose attention span may be quite short and volatile. For this reason, toys that "do" something are preferable. The thing that most preschool toys of this type do, is move. A favorite type of toy is the vehicle or animal that has wheels. Movement of the toy can be accomplished in a great many ways. A toy can be moved by the application of external force, such as a toy vehicle which is simply shoved along the ground by an adult or the infant himself. Other toys can be made self-propelled by the use of batteries, fuel or other power source. Still another method for moving the toy is by utilization of an internal windup mechanism, or something of that type.

Each of these types of toys have heretofore been subject to one or more drawbacks.

The toy which must be pushed or shoved along the ground typically does not prove to be a sufficient attraction to the child, and the child could quickly lose his interest in such a toy. This is a major drawback for a toy which cannot retain the attention of a child is no toy at all. The electrical or fuel-driven type toy is not well suited for preschool children for safety reasons. Lastly, the windup type toys are generally not suited for preschool because the windup mechanisms are not suited to the capabilities of a high number of preschool children. If a toy cannot be easily operated by the child, many children become frustrated and upset. This, of course, is undesirable, as a toy is to entertain the child, not upset him.

There therefore exists a need in the art for a toy which will provide to the child maximum pleasure while demanding no greater physical dexterity than a typical preschool child is likely to possess.

SUMMARY OF INVENTION

This invention provides such a toy which overcomes the deficiencies of the prior art in a wheeled toy which moves without fuel, batteries, motors, springs or windup mechanism. The toy is substantially constructed of a soft, compressible, resilient material; preferably, polyurethane or a foam rubber like material. The exterior of the material is sculpted to the desired exterior shape of the toy and can be made to resemble a truck, van or other vehicle, the shape of an animal, fish or bird, or any other number of shapes. The compressibility and resiliency of this material is captured to provide a motive force for the toy. The child playing with the toy simply presses down on a conveniently located compression plate thereby causing some compression of the resilient material. When the compression plate is released, the inherent "memory" of the material causes it to resume its original shape. In so doing, it moves the compression plate back to its original position. This movement of the compression plate back to its original position is captured by gear means and communicated to wheels or other transportation means which are journaled to the body of the toy.

Pushing down on the compression plate is a simple movement involving only the major muscle groups, which can typically be performed by a preschool age child. Once the compression plate is depressed and released, the vehicle zooms off at a rapid rate under its own power, to the continued delight of the child.

The soft exterior of the toy provides increased protection from injury to the child playing with the toy, to any other children in the area, and also to furniture and other items which might be struck by the toy.

It is therefore the object of this invention to provide an improved toy which utilizes the compressibility and resiliency of the body material of the toy to provide the motive means for the toy, which toy is designed to the physical dexterity of the preschool child, and provides a soft exterior for the protection of the child and other children and objects in the play area.

BRIEF DESCRIPTIONS OF THE DRAWING

FIG. 1 is a perspective view of the toy of this invention. The soft, compressible, resilient exterior is shown sculptured in the basic shape of a van or panel truck. Also shown is the compression plate located on the top of the vehicle.

FIG. 2 is a top view of the toy after the compression plate and the soft exterior body have been removed. Depicted in this figure is the base plate which provides a plate to which the gear box is attached and the axles and wheels are journaled. A portion of the gear box is cut away to show the gear train enclosed in the gear box.

FIG. 3 is a front view of the toy, showing the soft body portion of the toy in shadow. The compression plate is shown in its fully extended position, and, in shadow, in its fully retracted position. Also shown in this figure is the elongate member which slides within a channel in the gear box and the slot and peg means by which the elongate member is retained therein.

FIG. 4 is a side view of the toy, showing the interaction and interrelationship of the compression plate, the elongate member and the gear train. Also shown in this figure, in shadow, is the manner in which the compression plate compresses the soft resilient body material.

DESCRIPTION OF THE PREFERRED EMBODIMENT

Figure 1:
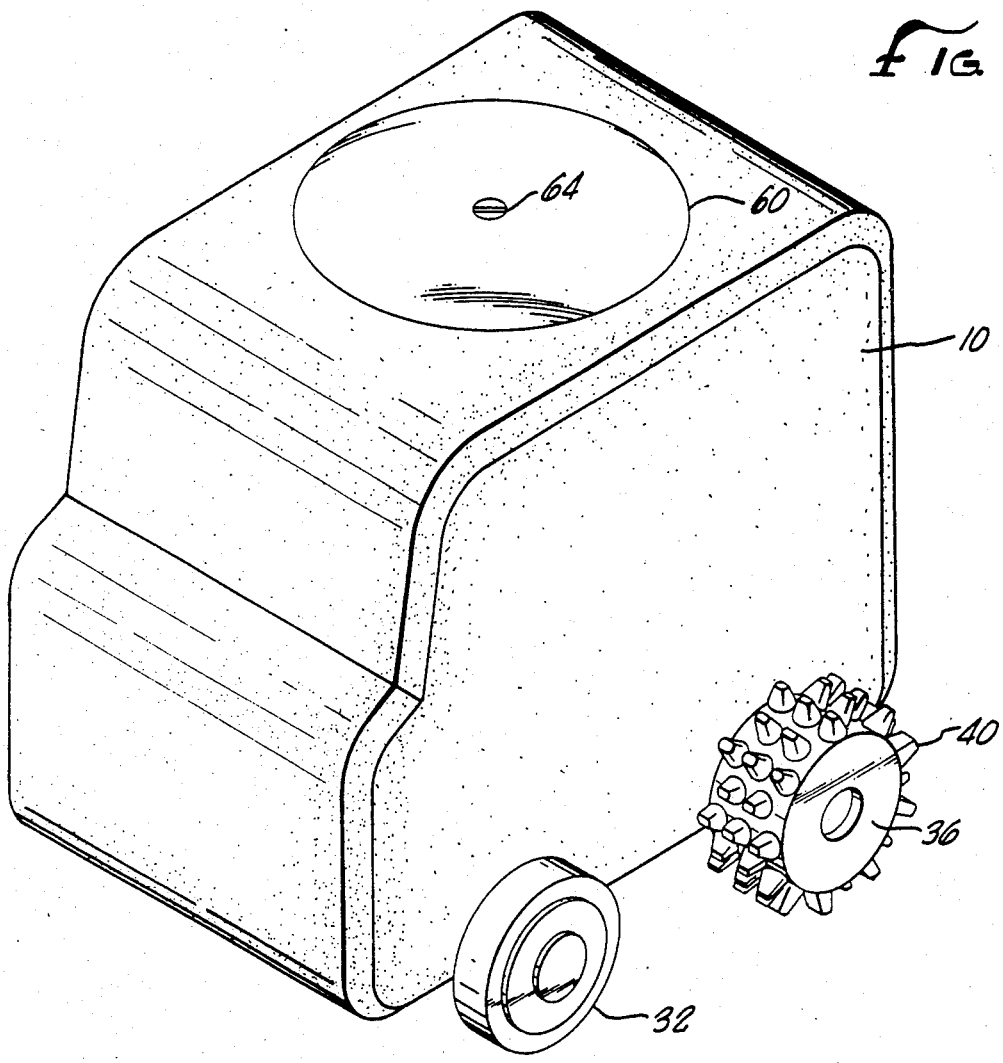
Figure 2:
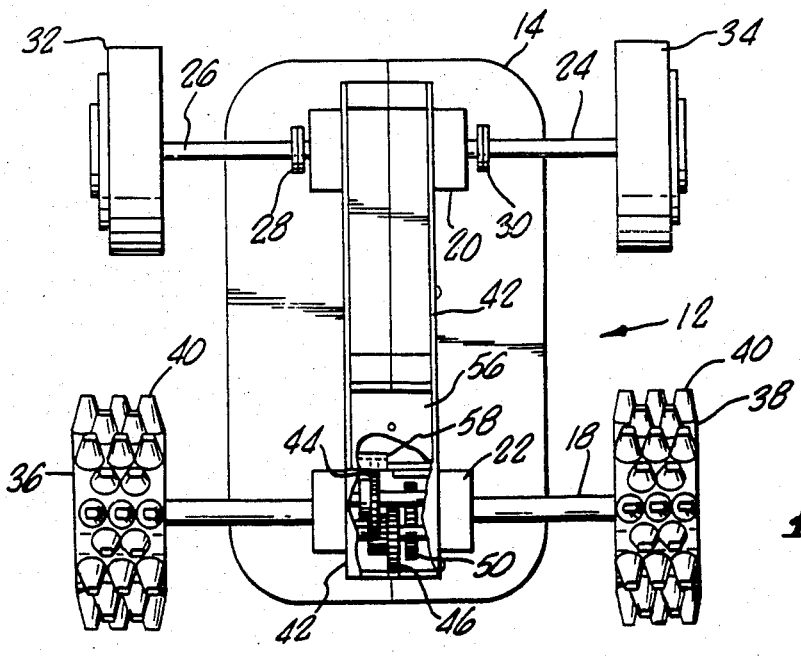

The preferred embodiment of this toy is depicted in the shape of a van or panel truck. It will be understood that the invention herein described and claimed has utility in a great number of different sizes and shapes of toy and is not therefore limited to this preferred embodiment.

As preferrably embodied, the toy is generally of two-part construction, the first part being the body 10 and the second part being the chassis of the toy, generally designated 12.

The body 10 is constructed from a single piece of polyurethane foam material, having high resiliency and high density, preferrably three and one-half pounds per cubic foot. This type material is available from a number of commercial sources. Other polyurethane, polymer, rubber or foam rubber-like material may be used. The body 10 is formed to the desired exterior shape of the resultant toy by molding, foamed in place process, die cut, or other process. In this preferred embodiment, a van or panel truck is shown. It will be understood that just as easily, a different vehicle such as a car, boat, or airplane could be depicted, as could any number of animals. In this preferred embodiment, the body 10 is approximately five inches high, four inches wide, and six inches long. A hollow chamber is formed in body 10 to accommodate therein various components of the chassis 12.

The chassis 12 has a base plate 14. The base plate can be made of any rigid durable material such as hard plastic or metal. Base plate 14 is nearly as large as the bottom of body 10, for reasons which will become apparent later herein. Journaled to base plate 14 is front axle 16 and rear axle 18. In this embodiment, axles 16 and 18 are metal shafts which extend through appropriately sized apertures in journal boxes 20 and 22 which are attached to base plate 14 by any conventional means. On front axle 16, spacers 24 and 26, which can be constructed of plastic tubing, are placed, along with washers 28 and 30 to keep the axle centrally located within journal box 20. Front wheels 32 and 34 are attached to axle 16 by conventional means. Rear wheels 36 and 38 are attached to rear axle 18 by conventional means. A tread 40 may be provided on wheels 36 and 38 to provide better traction.

Attached to base plate 14 by conventional means is a gear box 42. Gear box 42 houses a gear train consisting of several intermeshing gear wheels. The first gear wheel 44 meshes with a clutch gear 46. Clutch gear 46 is journaled in a slot 48 in the gear box such that the position of clutch gear 46 can change. Clutch gear 46, when it is in the down position in slot 48, engages second gear wheel 50. When clutch gear 46 is in the upward position in slot 48, it will not engage gear wheel 50. Clutch gear 46 and second gear wheel 50 are two-stage gear wheels, having a first stage of smaller diameter, and a second stage of larger diameter. Gear wheel 44 acts upon the smaller first stage of clutch gear 46 while the larger second stage of clutch gear 46 acts upon the smaller first stage of gear wheel 50. The larger second stage of gear wheel 50 in turn acts upon axle gear 52 which is fixably attached to rear axle 18 within gear box 42. Axle gear 52 also acts to centralize axle 18.

A channel 54 is formed in gear box 42. The channel is perpendicular to base plate 14 and adjacent to first gear wheel 44. The channel 54 has an open end at the top of gear box 42.

An elongate member 56 is slidable within channel 54 between a fully extended position within gear box 42 (as shown in FIG. 4) and a fully retracted position within gear box 42 (as shown in shadow in FIG. 4). Elongate member 56 is of sufficient length such that when it is in the fully extended position it reaches very nearly to the top of body 10 and still has a substantial portion which resides within channel 54 within gear box 42 at least as far as first gear 44. On the side of elongate member 56 adjacent to first gear wheel 44, a rack gear 58 is formed, or attached by conventional means. Rack gear 58 meshes with first gear wheel 44 such that as elongate member 56 is pushed downward within channel 54, rack gear 58 engages gear wheel 44 and turns it in a counterclockwise direction (as seen in FIG. 4). This movement of gear wheel 44 causes clutch gear 46 to move upwardly within slot 48 out of engagement with second gear wheel 50. As elongate member 56 is moved from its fully retracted position upwardly in channel 54 to its fully extended position, rack gear 58 causes gear wheel 44 to move in a clockwise position. This movement of gear wheel 44 acts upon clutch gear 46 drawing it downwardly within slot 48 into engagement with second gear wheel 50. Accordingly, the upward linear motion of elongate member 56 is converted by the action of rack gear 58 on first gear wheel 44 into clockwise rotational movement of gear wheel 44, which causes clutch gear 46 to rotate in a counterclockwise position, which, in turn, causes second gear wheel 50 to rotate in a counterclockwise direction, and finally, causes axle gear 52 and hence the wheels to rotate in a counterclockwise direction, moving the toy in a forward direction.

Attached to the top of elongate member 56 is a compression plate 60. Compression plate 60 is disc-shaped, and is preferrably constructed of any semi-rigid, durable material, such as plastic. Compression plate 60 may be attached to elongate member 56 by any conventional means. Here, a plug 62 is placed in the end of elongate member 56 and compression plate 60 is attached thereto by screw means 64.

Compression plate 60 is of a sufficient size such that when it is pressed against the top of body 10, it causes a substantial compression of the body 10 material.

The elongate member 56 is retained within channel 54 by means of slot 66 in gear box 42 adjacent to channel 54, and a peg 68 attached to elongate member 56, which peg extends through slot 66. This peg 68 retains elongate member 56 in channel 54.

As constructed thusly, when the body material 10 is in the uncompressed state, the elongate member 56 is held in the fully extended position within channel 54 by means of compression plate 60 which rests against the top of the body material 10. When the child playing with the toy presses down on compression plate 60, elongate member 56 is forced downwardly in channel 54 to its fully retracted position. As rack gear 58 on elongate member 56 engages first gear wheel 44 during this downward thrust, gear wheel 44 is turned in a counterclockwise direction. This lifts clutch gear 46 upwardly in slot 48 out of engagement with second gear wheel 50, so that the rotational motion of gear wheel 44 is not communicated to gear wheel 50. Once the elongate member is pushed to its fully retracted position and compression plate 60 is released, the natural resiliency of the body material 10 pushes against compression plate 60 returning it to its original position as the body material 10 returns to its natural form. As compression plate 60 is pushed upwardly, it pulls with it elongate member 56 bringing it again to its fully extended position. During this upward thrust of elongate member 56, rack gear 58 acts upon first gear wheel 44 to turn it in a clockwise position. This clockwise rotation of gear wheel 44 acts upon clutch gear 46, pulling it downwardly in slot 48, into engagement with second gear wheel 50. Gear wheel 50 is caused to rotate in a clockwise direction which causes axle gear 52, and hence the wheels, to also rotate in a counterclockwise direction moving the toy forward.

Although a preferred embodiment has been specifically described herein and depicted in the figures, it will be understood by those in the art that the inventive concepts embodied in this invention, and hereinafter claimed, are susceptible to many alternative embodiments and modifications. Accordingly, the invention is not be limited to the specific embodiment set forth and depicted above, but is of the full breath and scope of the appended claims.

What is claimed is:

1. A soft, easily propellable toy, comprising:

(a) a body having an exterior of soft, compressible, resilient material;

(b) transportation means attached to said body for moving the toy; and (c) conversion means attached to said body for converting the expansion of said compressible body material when said body is compressed and then released into rotational motion and communicating said rotational motion to said transportation means of the toy.

2. The toy of claim 1 wherein said conversion means comprises:

(a) compression means on said body, said compression means being designed, constructed and attached to said body such that pushing down on said compression means against said body causes substantial compression of said soft, compressible, resilient material;

(b) a member attached to said compression means and extending therefrom into said body such that as said compression means is pushed against said body material, said member is moved linearly along its axis, and when said compression means is released, the natural resiliency of said body material causes linear movement of said member in the reverse direction along its axis; and (c) gear means attached to said body for converting said linear motion of said member to rotational movement and communicating said rotational movement to said transportation means.

3. The toy of claim 2 wherein said gear means comprises:

(a) a rack gear on one end of said elongate member, said end being distal from said compression means; and (b) a gear train attached to said body and having a plurality of intermeshing gear wheels, one of which meshes with said rack gear and another of which meshes with said axle of the toy.

4. The toy of claim 3 wherein said soft, compressible, resilient material is a foam rubber-like material, such as polyurethane foam.

5. The toy of claim 4 wherein said transportation means are wheels.

6. The toy of claim 5 wherein said compression means comprises a compression plate.

7. The toy of claim 6 wherein said body comprises a base plate to which said wheels are journaled, and to which said gear train is attached, and a piece of soft, compressible, resilient material which rests upon said base plate.

8. The toy of claim 7 further comprising a gear box attached to said base plate, said gear box housing said gear train and having therein a channel, adjacent to said gear train, in which said member is slidable between a fully extended position and a fully retracted position.

9. The toy of claim 8 wherein said gear train comprises a first gear wheel which meshes with said rack gear on said member; a clutch gear which moves into and out of engagement with said first gear wheel depending on the direction of rotation thereof; and a second gear wheel which meshes with said clutch gear and also meshes with said wheel of the toy.

10. The toy of claim 9 wherein said compression plate has a circular configuration.

11. An easily propellable, soft toy, comprising:

(a) a base plate;

(b) at least one axle journaled through said base plate;

(c) at least one wheel attached to said axle;

(d) a gear wheel on said axle;

(e) a gear box attached to said base plate near said axle;

(f) a gear train in said gear box, said gear train comprising at least a first gear wheel, a second gear wheel and a clutch gear therebetween, said clutch gear designed and constructed so as to permit transfer of rotational movement from said first gear wheel to said second gear wheel in one direction only, said second gear wheel meshing with said axle gear wheel;

(g) a channel in said gear box adjacent to said first gear wheel;

(h) an elongate member slidable between a fully extended position and a fully retracted position in said gear box channel, said elongate member having a rack gear on a first end thereof, said rack gear engaging said first gear wheel of said gear train in said gear box, and having a second end extending out of and above said gear box, perpendicularly to said base plate;

(i) a body of soft, compressible, resilient material, sculptured to the desired exterior shape of the toy, having an interior cavity accommodating said gear box therein and allowing said elongate member to extend therethrough, said body fitted over said gear box and said elongate member, and resting upon said base plate, the relative dimensions of said body material, elongate member and gear box being designed and constructed such that when the body material is in the natural uncompressed position, said elongate member, in its fully extended position, reaches to the top of said body material; and (j) a compression plate attached to said second end of said elongate member whereby pressing on said compression plate causes the body material to be compressed and simultaneously pushes said elongate member through said channel in said gear box to a fully retracted position, and upon releasing said compression plate, the resiliency of said body material pushes against said compression plate thereby pulling said elongate member to its fully extended position, during which time, said rack gear on said elongate member acts upon said first gear wheel on said gear train, causing said wheel of the toy to rotate.

12. The toy of claim 11 wherein said soft, compressible, resilient material is foam rubber.

13. The toy of claim 12, wherein said foam rubber is a polyurethane foam rubber.

* * * * *